US010991288B2

(12) United States Patent
Yang et al.

(10) Patent No.: US 10,991,288 B2
(45) Date of Patent: Apr. 27, 2021

(54) DISPLAY DRIVING DEVICE

(71) Applicant: SILICON WORKS CO., LTD., Daejeon (KR)

(72) Inventors: Su Hun Yang, Gwangmyeong-si (KR); Kyung Jik Min, Daejeon (KR); Won Kab Oh, Daejeon (KR); Jeong Hie Choi, Cheongju-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/322,609

(22) PCT Filed: Jul. 13, 2017

(86) PCT No.: PCT/KR2017/007499
§ 371 (c)(1),
(2) Date: Feb. 1, 2019

(87) PCT Pub. No.: WO2018/026114
PCT Pub. Date: Feb. 8, 2018

(65) Prior Publication Data

US 2020/0152107 A1 May 14, 2020

(30) Foreign Application Priority Data

Aug. 3, 2016 (KR) ..... 10-2016-0098783
Jun. 27, 2017 (KR) ..... 10-2017-0081375

(51) Int. Cl.
*G09G 3/20* (2006.01)

(52) U.S. Cl.
CPC ..... *G09G 3/20* (2013.01); *G09G 2310/027* (2013.01); *G09G 2320/0233* (2013.01); *G09G 2320/0295* (2013.01); *G09G 2360/16* (2013.01)

(58) Field of Classification Search
CPC ..... G09G 2320/04–048; G09G 3/20; G09G 2310/027; G09G 2320/0295; G09G 2360/16; G09G 2320/0233
See application file for complete search history.

(56) References Cited

U.S. PATENT DOCUMENTS 10,360,826 B2 * 7/2019 Bi ..... G09G 3/006
2015/0379909 A1 * 12/2015 Yu ..... G09G 3/2007 345/690

(Continued)

FOREIGN PATENT DOCUMENTS

KR 10-2015-0037117 4/2015
KR 10-2015-0073694 7/2015

(Continued)

OTHER PUBLICATIONS

International Search Report for International Application No. PCT/KR2017/007499, dated Oct. 19, 2017.

(Continued)

*Primary Examiner* — Bryan Earles
(74) *Attorney, Agent, or Firm* — Polsinelli PC

(57) ABSTRACT

Disclosed is a display driving device that supports accurate correction of the characteristics of pixels by reflecting the characteristics of a source driver in realtime. The display driving device may include: a sensing circuit configured to sense pixel signals for correcting characteristics of pixels of a display panel and sense at least one reference signal for correcting characteristics of a source driver when sensing the pixel signals; and an analog digital converter configured to convert the pixel signals and the at least one reference signal sensed by the sensing circuit into pixel data and reference data, and to transmit the pixel data and the reference data.

20 Claims, 4 Drawing Sheets

(56) References Cited

U.S. PATENT DOCUMENTS

| | | | | |
|---|---|---|---|---|
| 2016/0078805 | A1* | 3/2016 | Woo | G09G 3/3225 345/78 |
| 2017/0004776 | A1* | 1/2017 | Park | G09G 3/3233 |

FOREIGN PATENT DOCUMENTS

| | | |
|---|---|---|
| KR | 10-2015-0078099 | 7/2015 |
| KR | 10-2015-0078358 | 7/2015 |
| KR | 10-1549343 | 9/2015 |
| KR | 10-2016-0078629 | 7/2016 |
| KR | 10-2017-0018133 | 2/2017 |
| KR | 10-2017-0036569 | 4/2017 |
| KR | 10-2017-0038985 | 4/2017 |

OTHER PUBLICATIONS

Written Opinion for International Application No. PCT/KR2017/007499 with English translation, dated Oct. 19, 2017.

* cited by examiner

DISPLAY DRIVING DEVICE

BACKGROUND

1. Technical Field

The present disclosure relates to a display device, and more particularly, to a technology that supports accurate correction of the characteristics of pixels by reflecting the characteristics of a source driver in realtime.

2. Related Art

In general, a display device includes a display panel, a source driver, a timing controller and the like.

The source driver converts digital image data provided from the timing controller into a source driving signal, and provides the source driving signal to the display panel. The source driver includes one chip and may include a plurality of chips in consideration of the size and resolution of the display panel.

Meanwhile, a large-area display panel may have characteristic deviations between pixels. In order to correct the characteristic deviations, the source driver converts pixel voltages into digital data and provides the digital data to the timing controller. However, since the digital data includes not only the pixel characteristics but also the characteristics of the source driver, it is necessary to remove the characteristics.

Furthermore, since the characteristics of the source driver such as gain and offset may vary depending on a power supply voltage, temperature and the like, a process for correcting the characteristics of the source driver is necessary.

To this end, in the related art, time for correcting the characteristics of the source driver is allocated to acquire data of all channels for a specific input value more than once, the characteristics of the source driver are corrected, and then pixel characteristics are corrected by detecting pixel voltages.

However, the aforementioned related art has a disadvantage that a correction time increases because the same operation for correction is repeated at least twice.

Furthermore, in the related art, since ambient environments (temperature, a power supply voltage and the like) of the time for correcting the characteristics of the source driver and the time for correcting the pixel characteristics may be different from each other, the accuracy of correction for the characteristics of the source driver and the pixel characteristics is reduced, so that an image problem such as block dim may occur.

SUMMARY

Various embodiments are directed to a display driving device capable of accurately correcting the characteristics of a pixel by reflecting the changing characteristics of a source driver in realtime and shortening a correction time.

In an embodiment, a display driving device may include: a sensing circuit configured to sense pixel signals for correcting characteristics of pixels of a display panel and to sense at least one reference signal for correcting characteristics of a source driver when sensing the pixel signals; and an analog digital converter configured to convert the pixel signals and the at least one reference signal sensed by the sensing circuit into pixel data and reference data, and to transmit the pixel data and the reference data.

In an embodiment, a display driving device may include: a first sensing channel unit configured to sense pixel signals for correcting characteristics of pixels of a display panel; a second sensing channel unit configured to sense at least one reference signal for correcting characteristics of a source driver; a selection unit configured to sequentially output the pixel signals and the at least one reference signal sensed by the first sensing channel unit and the second sensing channel unit according to a prescribed order; and an analog digital converter configured to convert the pixel signals and the at least one reference signal outputted by the selection unit into pixel data and reference data, and to transmit the pixel data and the reference data.

In an embodiment, a display driving device may include: a sensing channel unit including sensing channels for sensing pixel signals for correcting characteristics of pixels of a display panel, some of the sensing channels selectively sensing at least one pixel signal and at least one reference signal for correcting characteristics of a source driver; a selection unit configured to sequentially output the pixel signals and the at least one reference signal sensed by the sensing channel unit according to a prescribed order; and an analog digital converter configured to convert the pixel signals and the at least one reference signal outputted by the selection unit into pixel data and reference data, and to transmit the pixel data and the reference data.

According to embodiments of the present invention, the pixel signals for correcting the characteristics of the pixels and the reference signals for correcting the characteristics of the source driver are simultaneously sensed and the characteristics of the pixels and the characteristics of the source driver are simultaneously corrected, so that it is possible to shorten a correction time and improve the accuracy of correction.

Furthermore, it is possible to improve the accuracy of correction, so that it is possible to solve an image problem such as block dim.

Furthermore, according to the present invention, the pixel signals for correcting the characteristics of the pixels and the reference signals for correcting the characteristics of the source driver are simultaneously acquired, so that it is possible to reflect in realtime a change in the characteristics of the source driver due to a change in ambient environments such as temperature and a power supply voltage.

DETAILED DESCRIPTION

Figure 1:
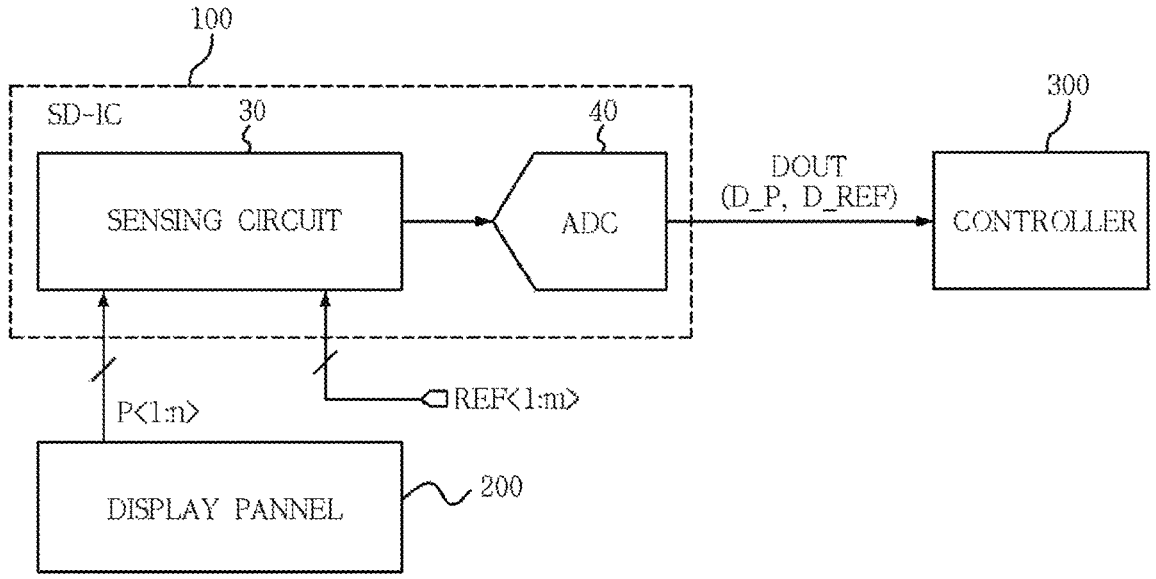
FIG. 1 is a block diagram of a display driving device in accordance with an embodiment of the present invention.

Hereafter, embodiments of the present invention will be described in detail with reference to the accompanying drawings. The terms used in this specification and claims are not limited to typical dictionary definitions, but should be interpreted as meanings and concepts which coincide with the technical idea of the present invention.

Embodiments described in this specification and configurations illustrated in the drawings are preferred embodiments of the present invention, and do not represent the entire technical idea of the present invention. Thus, various equivalents and modifications capable of replacing the embodiments and configurations may be provided at the time that the present application is filed.

FIG. 1 is a block diagram of a display driving device in accordance with an embodiment of the present invention.

Referring to FIG. 1, a display driving device 100 in accordance with an embodiment of the present invention includes source drivers SD-IC that provide a source driving signal to a display panel 200. Each source driver SD-IC includes one chip and the number of source drivers SD-IC may be decided in consideration of the size and resolution of the display panel 200. In the present invention, only one source driver is illustrated for the convenience of description.

As the display panel 200, a liquid crystal panel, an OLED (Organic Light Emitting Diode) panel and the like may be used.

The display panel 200 includes a pixel array in the form of a matrix, and the pixel array may include R (red), G (green), and B (blue) pixels or may additionally include a W (white) pixel for luminance improvement. Each pixel includes a light emitting element and a pixel circuit that supplies the light emitting element with a current corresponding to a source driving signal provided from the display driving device 100. The pixel circuit includes a driving transistor that provides the light emitting element with the current corresponding to the source driving signal. Characteristics of such a driving transistor, such as a threshold voltage and mobility according to pixel positions, or characteristics such as a threshold voltage of the light emitting element may be non-uniform, or a luminance non-uniformity phenomenon may occur depending on degradation deviations of the driving transistor and the light emitting element with the lapse of a driving time.

In order to correct the characteristics of the pixels as described above, the display driving device 100 senses pixel signals P<1:n> indicating the characteristics of the pixels of the display panel 200, converts the pixel signals P<1:n> into pixel data D_P, and provides the pixel data D_P to a controller 300. In an example, the display driving device 100 may be configured to sense a pixel voltage or a pixel current with the pixel signals P<1:n>.

The pixel data D_P corresponding to the pixel signals P<1:n> may be used to calculate the characteristics of the driving transistor, such as a threshold voltage and mobility, or the degradation characteristics such as the threshold voltage of the light emitting element. Since a pixel current flowing through the light emitting element varies depending on the threshold voltage and mobility of the driving transistor and the threshold voltage of the light emitting element, the pixel current may be used to calculate the characteristic values of the pixels, and the characteristic values of the pixels may be used to compensate for digital image data.

Furthermore, the pixel data D_P may include not only the characteristics of the pixels but also the characteristics such as offset and gain of the source driver. Accordingly, the present invention discloses the display driving device 100 that supports simultaneous correction of the characteristics of the source driver when the characteristics of the pixels are corrected.

To this end, the display driving device 100 of the present invention simultaneously senses reference signals REF<1:m> for correcting the characteristics of the source driver when the pixel signals P<1:n> for correcting the characteristics of the pixels are sensed, converts the pixel signals P<1:n> and the reference signals REF<1:m> into digital data DOUT, and provides the controller 300 with the pixel data D_P corresponding to the pixel signals P<1:n> and reference data D_REF corresponding to the reference signals REF<1:m>.

The aforementioned display driving device 100 includes a sensing circuit 30 that senses the pixel signals P<1:n> and the reference signals REF<1:m> and an analog digital converter (ADC) 40 that converts the pixel signals P<1:n> and the reference signals REF<1:m> into the pixel data D_P and the reference data D_REF.

The sensing circuit 30 that simultaneously senses the pixel signals P<1:n> for correcting the pixel characteristics and the reference signals REF<1:m> for correcting the characteristics of the source driver. Such a sensing circuit 30 may be configured to sense the reference signals REF<1:m> by using separate sensing channels or to sense the reference signals REF<1:m> by using some of sensing channels for sensing the pixel signals P<1:n>. The reference signals REF<1:m> may be defined as a voltage having a constant level with respect to a change in ambient environments such as temperature and a power supply voltage, and may be provided from the outside.

In an example, the sensing circuit 30 may include sample and hold circuits, and may include sample and hold circuits for sampling the pixel signals P<1:n> and separate sample and hold circuits for sampling at least one of the reference signals REF<1:m>. Alternatively, in the sensing circuit 30, some of the sample and hold circuits for sampling the pixel signals P<1:n> may be configured to selectively sample at least one pixel signal and at least one of the reference signals REF<1:m>.

Furthermore, the sensing circuit 30 may be configured to sense one reference signal REF<1> or two or more reference signals REF<1:m>. The controller 300 can calculate an offset value of the source driver by using the reference data D_REF corresponding to one reference signal REF<1> and offset and gain values of the source driver by using two or more reference signals REF<1:m>.

The sensing circuit 30 sequentially outputs the sensed pixel signals P<1:n> and reference signals REF<1:m> to the analog digital converter (ADC) 40 according to a prescribed order.

The analog digital converter (ADC) 40 respectively converts the sensed pixel signals P<1:n> and the reference signals REF<1:m> sequentially outputted from the sensing circuit 30 into the pixel data D_P and the reference data D_REF, and simultaneously provides the pixel data D_P and the reference data D_REF to the controller 300.

The controller 300 calculates the characteristic values of the pixels by using the pixel data D_P, calculates the characteristic values of the source driver by using the reference data D_REF, and corrects the characteristic values of the pixels by using the characteristic values of the source driver. Furthermore, the controller 300 generates compensation data by using the corrected characteristic values of the pixels, and compensates for digital image data by using the compensation data.

As described above, the display driving device of the present invention is configured to simultaneously sense the pixel signals P<1:n> capable of identifying the characteristics of the pixels and the reference signals REF<1:m> capable of identifying the characteristics of the source driver at the same time, and simultaneously provides the controller 300 with the pixel data D_P corresponding to the pixel signals P<1:n> and the reference data D_REF corresponding to the reference signals REF<1:m>.

According to the present invention configured as above, the pixel signals P<1:n> for correcting the characteristics of the pixels and the reference signals REF<1:m> for correcting the characteristics of the source driver are simultaneously sensed and the characteristics of the pixels and the characteristics of the source driver are simultaneously corrected, so that it is possible to shorten a correction time and improve the accuracy of correction. Furthermore, it is possible to solve an image problem such as block dim.

As described above, according to the present invention, the pixel signals P<1:n> for correcting the characteristics of the pixels and the reference signals REF<1:m> for correcting the characteristics of the source driver are simultaneously acquired, so that it is possible to reflect in realtime a change in the characteristics of the source driver due to a change in ambient environments such as temperature and a power supply voltage.

Figure 2:
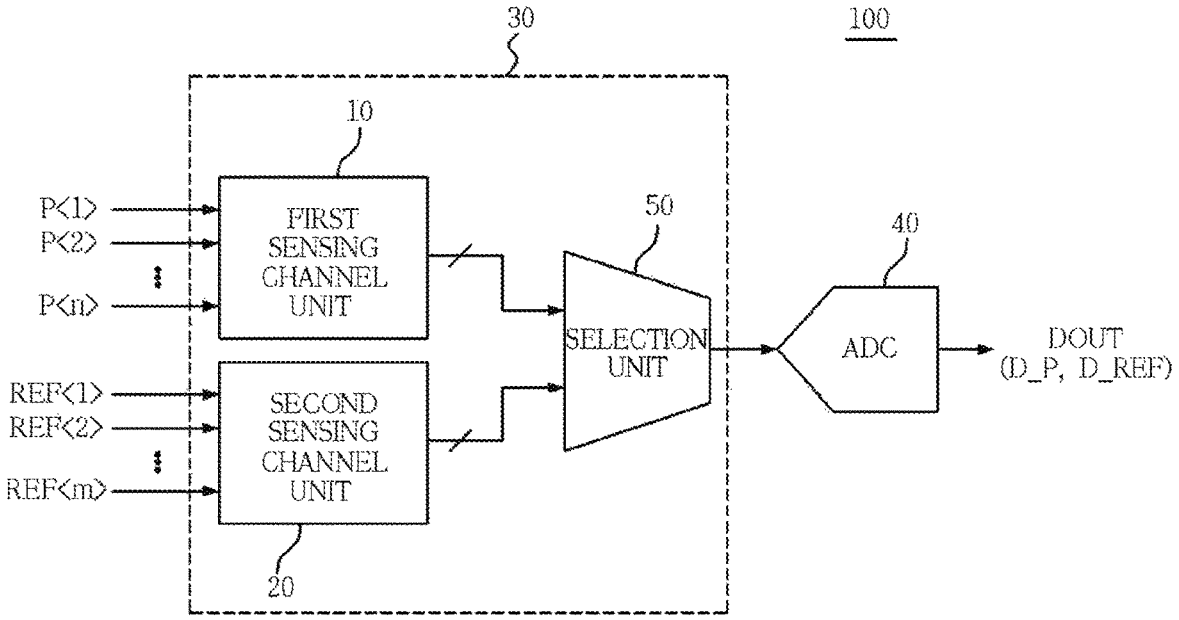
FIG. 2 is a block diagram of a sensing circuit of FIG. 1 in accordance with an embodiment of the present invention.

FIG. 2 is a block diagram of the sensing circuit 30 of FIG. 1 in accordance with an embodiment of the present invention.

Referring to FIG. 2, the sensing circuit 30 includes a first sensing channel unit 10, a second sensing channel unit 20, and a selection unit 50.

The first sensing channel unit 10 senses the pixel signals P<1:n> for correcting the characteristics of the pixels of the display panel 200, and the second sensing channel unit 20 senses at least one of the reference signals REF<1:m> provided from the outside in order to correct the characteristics of the source driver. Such a first sensing channel unit 10 senses the pixel signals P<1:n> through sensing channels corresponding to sensing lines of the display panel 200 in a one-to-one manner, and the second sensing channel unit 20 senses the reference signals REF<1:m> through sensing channels separately provided.

In an example, the first sensing channel unit 10 and the second sensing channel unit 20 may include sample and hold circuits, and the number of sample and hold circuits may correspond to the number of pixel signals P<1:n> and the number of reference signals REF<1:m>. The second sensing channel unit 20 may be configured to simultaneously sense at least one of the reference signals REF<1:m> in synchronization with the first sensing channel unit 10 at a time at which the first sensing channel unit 10 senses the pixel signals P<1:n>.

The selection unit 50 may be configured to sequentially provide the pixel signals P<1:n> and the reference signals REF<1:m> sensed by the first sensing channel unit 10 and the second sensing channel unit 20 to the analog digital converter (ADC) 40 according to a prescribed order.

The analog digital converter (ADC) 40 converts the pixel signals P<1:n> and the reference signals REF<1:m> sequentially outputted by the selection unit 50 into the pixel data D_P and the reference data D_REF, respectively. Such pixel data D_P and reference data D_REF may be provided to the controller 300.

The controller 300 calculates the characteristic values of the pixels by using the pixel data D_P, calculates the characteristic values of the source driver by using the reference data D_REF, and corrects the characteristic values of the pixels by using the characteristic values of the source driver.

As described above, according to the present invention, correction of the characteristics of the source driver is simultaneously performed when the characteristics of the pixels are corrected, so that it is possible to shorten a correction time. Furthermore, since times for acquiring the pixel signals P<1:n> and the reference signals REF<1:m> are identical to each other, it is possible to reflect in realtime a change in the characteristics of the source driver due to a change in ambient environments such as temperature and a power supply voltage.

In the description of FIG. 1 and FIG. 2, the present embodiment has described that the pixel data D_P and the reference data D_REF corresponding to the pixel signals P<1:n> and the reference signals REF<1:m> are transmitted to the controller 300; however, the pixel data D_P and the reference data D_REF may be calculated according to a data format requested by the controller 300 and may be provided to the controller 300. In an example of the present embodiment, calculation data D_CAL (illustrated in FIG. 4) obtained by correcting the reference data D_REF indicating the characteristics of the source driver from the pixel data D_P indicating the characteristics of the pixels may be provided to the controller 300.

Figure 3:
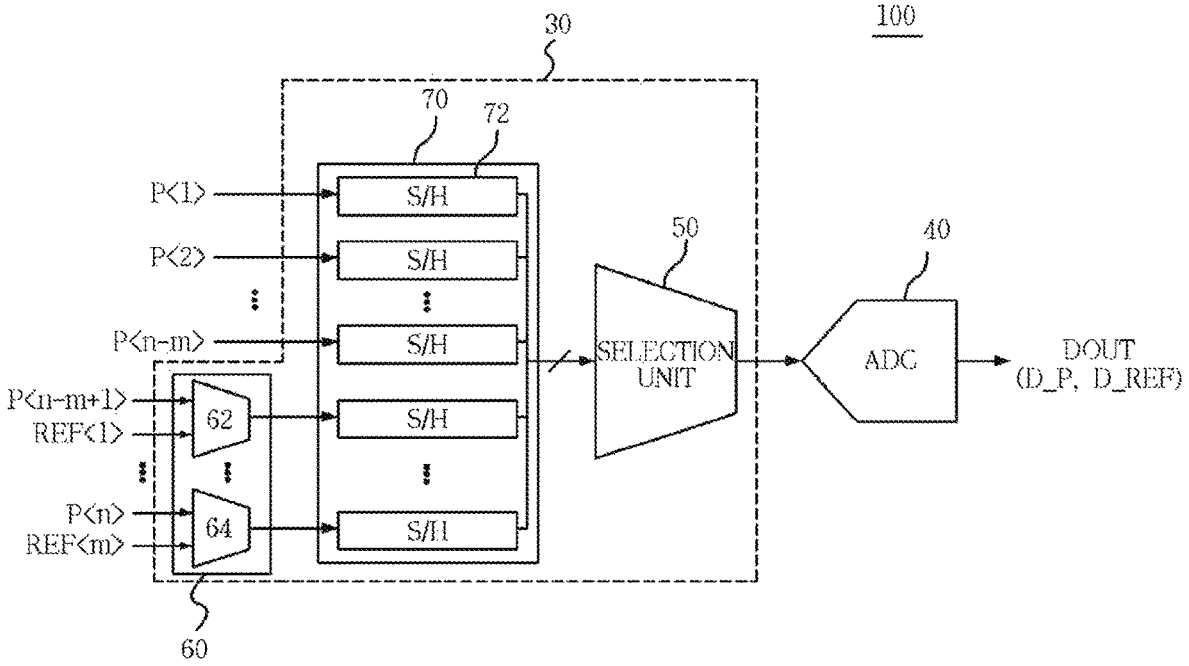
FIG. 3 is a block diagram of a sensing circuit of FIG. 1 in accordance with another embodiment of the present invention.

FIG. 3 is a block diagram of the sensing circuit 30 of FIG. 1 in accordance with another embodiment of the present invention.

Referring to FIG. 3, the sensing circuit 30 includes a switching unit 60, a sensing channel unit 70, and the selection unit 50.

The sensing channel unit 70 may include sample and hold circuits 72 corresponding to the pixel signals P<1:n> in a one-to-one manner, and among the sample and hold circuits 72, some may be configured to sample pixel signals P<1:n−m> and remaining some may be configured to sample the reference signals REF<1:m>. That is, in the embodiment of FIG. 3, among the sample and hold circuits 72 that sample the pixel signals P<1:n>, some may be configured to sample the pixel signals P<1:n−m> and the others may be configured to selectively sample the reference signals REF<1:m> and the other pixel signals P<1:n−m+1>.

The switching unit 60 selectively transfers pixel signals P<n−m+1:n> and the reference signals REF<1:m> to the sensing channel unit 70. The switching unit 60 includes selectors 62 and 64 and transfers the pixel signals P<n−m+1:n> or the reference signals REF<1:m> to the sensing channel unit 70 in response to a prescribed control signal.

The selection unit 50 may be configured to sequentially provide the pixel signals P<1:n−m> and the reference signals REF<1:m> sensed by the sensing channel unit 70 to the analog digital converter (ADC) 40 according to a prescribed order.

The analog digital converter (ADC) 40 converts the pixel signals P<1:n−m> and the reference signals REF<1:m> sequentially outputted by the selection unit 50 into the pixel data D_P and the reference data D_REF, respectively. Such pixel data D_P and reference data D_REF may be provided to the controller 300, and may be used to calculate the characteristic values of the pixels and the characteristic values of the source driver.

As described above, according to the present invention, correction of the characteristics of the source driver is simultaneously performed when the characteristics of the pixels are corrected, so that it is possible to shorten a correction time. Furthermore, since times for acquiring the pixel signals P<1:n> and the reference signals REF<1:m> are identical to each other, it is possible to reflect in realtime a change in the characteristics of the source driver due to a change in ambient environments such as temperature and a power supply voltage.

In the description of FIG. 1 and FIG. 3, the present embodiment has described that the pixel data D_P and the reference data D_REF corresponding to the pixel signals P<1:n> and the reference signals REF<1:m> are transmitted to the controller 300; however, the pixel data D_P and the reference data D_REF may be calculated according to a data format requested by the controller 300 and may be provided to the controller 300. In an example of the present embodiment, calculation data D_CAL (illustrated in FIG. 4) obtained by correcting the reference data D_REF indicating the characteristics of the source driver from the pixel data D_P indicating the characteristics of the pixels may be provided to the controller 300.

Figure 4:
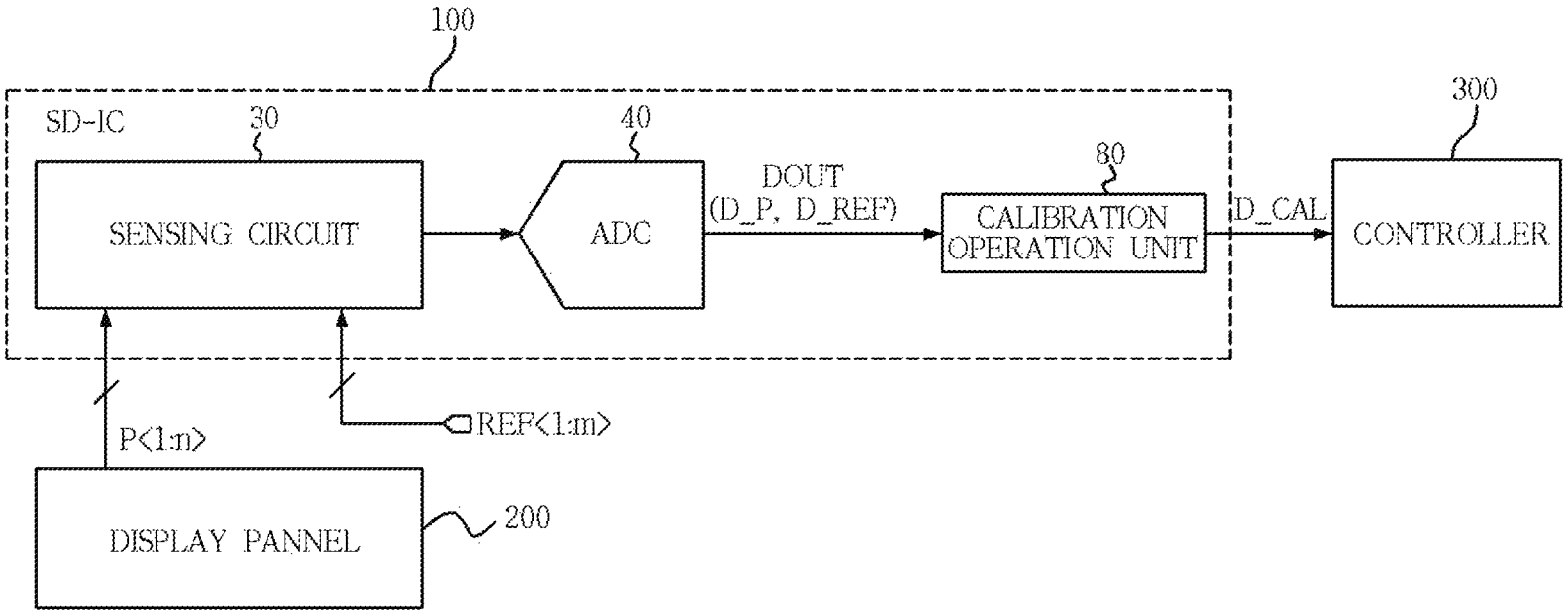
FIG. 4 is a block diagram of a display driving device in accordance with another embodiment of the present invention.

FIG. 4 is a block diagram of a display driving device in accordance with another embodiment of the present invention.

Referring to FIG. 4, a display driving device 100 in accordance with the embodiment of the present invention includes the sensing circuit 30, the analog digital converter (ADC) 40, and a correction calculation unit 80.

The sensing circuit 30 that simultaneously senses the pixel signals P<1:n> for correcting the characteristics of the pixels of the display panel 200 and the reference signals REF<1:m> for correcting the characteristics of the source driver. Such a sensing circuit 30 may be configured to sense the pixel signals P<1:n> through the sensing channels corresponding to the sensing lines of the display panel 200 in a one-to-one manner and to sense the reference signals REF<1:m> through the sensing channels separately provided as illustrated in FIG. 2. Alternatively, the sensing circuit 30 may be configured to sense the reference signals REF<1:m> by using some of the sensing channels corresponding to the sensing lines of the display panel 200 in a one-to-one manner as illustrated in FIG. 3.

The analog digital converter (ADC) 40 converts the pixel signals P<1:n> and the reference signals REF<1:m> sensed by the sensing circuit 30 into the pixel data D_P and the reference data D_REF, respectively. The pixel data D_P corresponding to the pixel signals P<1:n> may be used to calculate the characteristics of the driving transistor in the pixel circuit, such as the threshold voltage and mobility of the driving transistor, and the degradation characteristics such as the threshold voltage of the light emitting element in the pixel circuit.

Since a pixel current flowing through the light emitting element varies depending on the threshold voltage and mobility of the driving transistor and the threshold voltage of the light emitting element, the pixel current may be used to calculate the characteristic values of the pixels as above. The reference data D_REF corresponding to the reference signals REF<1:m> may be used to calculate characteristic values such as offset and gain of the source driver.

The correction calculation unit 80 calculates the pixel data D_P and the reference data D_REF so as to correspond to a format requested by the controller 300, and provides calculation data D_CAL to the controller 300. In an example, the correction calculation unit 80 may be configured to generate the calculation data D_CAL obtained by correcting the characteristics of the source driver from the characteristics of the pixels by using the pixel data D_P indicating the characteristics of the pixels and the reference data D_REF indicating the characteristics of the source driver, and to provide the controller 300 with the calculation data D_CAL obtained by correcting the characteristics of the source driver.

The controller 300 calculates the characteristic values of the pixels by using the calculation data D_CAL received from the correction calculation unit 80, generates compensation data corresponding to the characteristic values of the pixels, and compensates for digital image data by using the compensation data. The controller 300 generates the compensation data for correcting the characteristics of the pixels by using the calculation data D_CAL obtained by correcting the characteristics of the source driver, so that it is possible to simplify a logic required for correction and to shorten a correction time.

Figure 5:
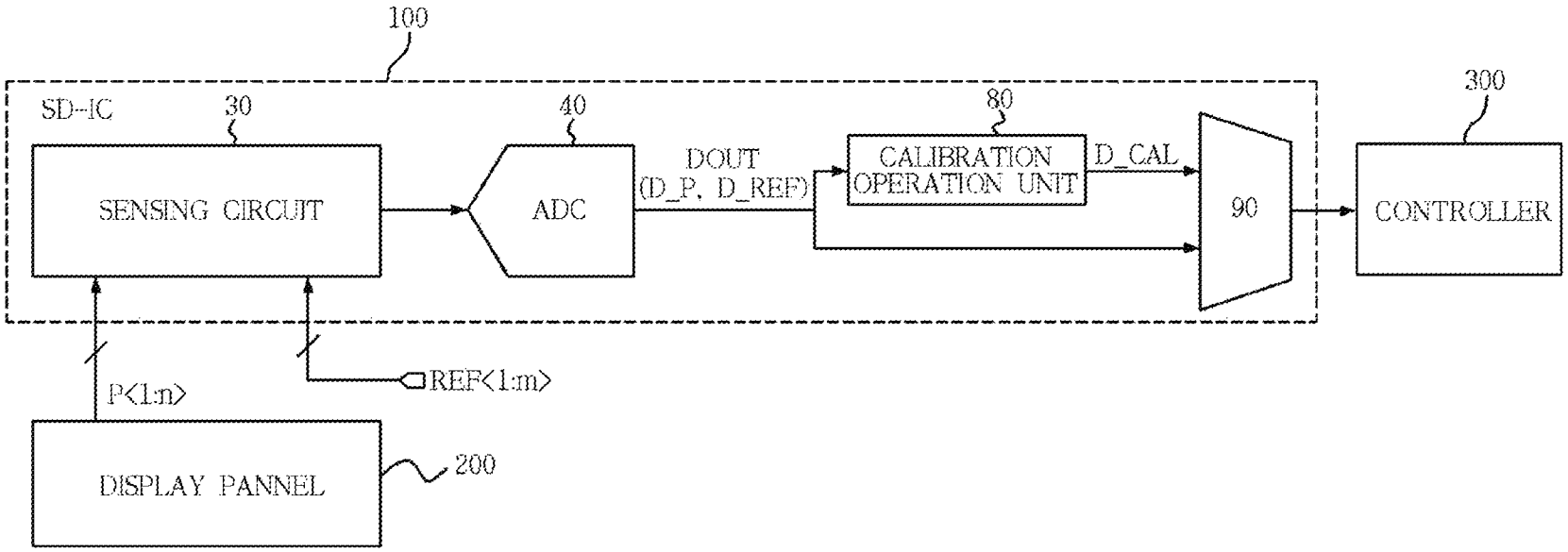
FIG. 5 is a block diagram of a display driving device in accordance with further another embodiment of the present invention.

FIG. 5 is a block diagram of a display driving device in accordance with another embodiment of the present invention.

Referring to FIG. 5, a display driving device 100 in accordance with the embodiment of the present invention includes the sensing circuit 30, the analog digital converter (ADC) 40, the correction calculation unit 80, and a transfer unit 90.

The sensing circuit 30 that simultaneously senses the pixel signals P<1:n> for correcting the characteristics of the pixels of the display panel 200 and the reference signals REF<1:m> for correcting the characteristics of the source driver. Such a sensing circuit 30 may be configured to sense the pixel signals P<1:n> through the sensing channels corresponding to the sensing lines of the display panel 200 in a one-to-one manner and to sense the reference signals REF<1:m> through the sensing channels separately provided as illustrated in FIG. 2. Alternatively, the sensing circuit 30 may be configured to sense the reference signals REF<1:m> by using some of the sensing channels corresponding to the sensing lines of the display panel 200 in a one-to-one manner as illustrated in FIG. 3.

The analog digital converter (ADC) 40 converts the pixel signals P<1:n> and the reference signals REF<1:m> sensed by the sensing circuit 30 into the pixel data D_P and the reference data D_REF, respectively. The pixel data D_P corresponding to the pixel signals P<1:n> may be used to calculate the characteristics of the driving transistor in the pixel circuit, such as the threshold voltage and mobility of the driving transistor, and the degradation characteristics such as the threshold voltage of the light emitting element in the pixel circuit. Since a pixel current flowing through the light emitting element varies depending on the threshold voltage and mobility of the driving transistor and the threshold voltage of the light emitting element, the pixel current may be used to calculate the characteristic values of the pixels as above. The reference data D_REF corresponding to the reference signals REF<1:m> may be used to calculate characteristic values such as offset and gain of the source driver.

The correction calculation unit 80 calculates the pixel data D_P and the reference data D_REF so as to correspond to a format requested by the controller 300. In an example, the correction calculation unit 80 may generate calculation data D_CAL obtained by correcting the characteristics of the source driver from the characteristics of the pixels by using the pixel data D_P indicating the characteristics of the pixels and the reference data D_REF indicating the characteristics of the source driver.

The transfer unit 90 transfers the calculation data D_CAL to the controller 300 or transfers the pixel data D_P and the reference data D_REF to the controller 300. Such a transfer unit 90 may be set to transfer the calculation data D_CAL or the pixel data D_P and the reference data D_REF in correspondence to a request of the controller 300.

The controller 300 calculates the characteristic values of the pixels by using the calculation data D_CAL when the calculation data D_CAL is received from the transfer unit 90, generates compensation data corresponding to the characteristic values of the pixels, and compensates for digital image data by using the compensation data. Alternatively, when the pixel data D_P and the reference data D_REF are received from the transfer unit 90, the controller 300 calculates the characteristic values of the pixels and the characteristic values of the source driver by using the pixel data D_P and the reference data D_REF, generates compensation data by using the characteristic values of the pixels and the characteristic values of the source driver, and compensates for digital image data by using the compensation data.

As described above, according to the display driving device of the present invention, the pixel signals P<1:n> for correcting the characteristics of the pixels and the reference signals REF<1:m> for correcting the characteristics of the source driver are sensed at the same time, the pixel signals P<1:n> and the reference signals REF<1:m> are converted into the pixel data D_P and the reference data D_REF, and the calculation data D_CAL obtained by correcting the characteristics of the source driver from the characteristics of the pixels through calculation of the pixel data D_P and the reference data D_REF is provided to the controller 300, so that it is possible to simplify a logic (calculation) required for correction data generation of the controller 300, to shorten a correction time, and to improve the accuracy of correction.

As described above, according to the present invention, the pixel signals P<1:n> for correcting the characteristics of the pixels and the reference signals REF<1:m> for correcting the characteristics of the source driver are simultaneously acquired, so that it is possible to reflect in realtime a change in the characteristics of the source driver due to a change in ambient environments such as temperature and a power supply voltage.

While various embodiments have been described above, it will be understood to those skilled in the art that the embodiments described are by way of example only. Accordingly, the disclosure described herein should not be limited based on the described embodiments.

What is claimed is:

1. A source driver comprising:

a sensing circuit configured to sense pixel signals for correcting characteristics of pixels of a display panel, to sense at least one reference voltage for correcting characteristics of the source driver when sensing the pixel signals, and to output the pixel signals and the at least one reference voltage to an analog digital converter; and the analog digital converter configured to convert the pixel signals sensed by the sensing circuit into pixel data and to convert the at least one reference voltage sensed by the sensing circuit into reference data that is digital values, and to transmit the pixel data and the reference data, wherein the reference data is used to correct the characteristics of the source driver, a first sensing channel unit configured to sense the pixel signals;

a second sensing channel unit configured to selectively sense the pixel signals and the at least one reference voltage; and a switching unit configured to selectively transfer the pixel signals and the at least one reference voltage to the second sensing channel unit, wherein the switching unit transfers the at least one reference voltage to the second sensing channel unit so that the second sensing channel unit senses the at least one reference voltage when the first sensing channel unit senses the pixel signals.

2. The source driver of claim 1, wherein the second sensing channel unit senses the at least one referee voltage in synchronization with the first sensing channel unit.

3. The source driver of claim 1, wherein the sensing circuit comprise:

sample and hold circuits corresponding to the pixel signals in a one-to-one manner, wherein at let one of the sample and hold circuits samples the at let one reference voltage and remaining sample and hold circuits sample the pixel signals.

4. The source driver of claim 1, wherein the reference voltage is set to maintain a constant level with respect to an ambient environment factor.

5. The source driver of claim 1, further comprising:

a correction calculation unit configured to calculate the pixel data and the reference data and to output calculation data obtained by correcting the characteristics of the source driver from the characteristics of the pixels to a controller.

6. The source driver of claim 1, further comprising:

a correction calculation unit configured to calculate the pixel data and the reference data and to output calculation data obtained by correcting the characteristics of the source driver from the characteristics of the pixels; and a transfer unit configured to transfer the calculation data to a controller or transfer the pixel data and the reference data to the controller.

7. The source driver of claim 6, wherein the controller corrects the characteristics of the pixels and offset and gain characteristics of the source driver by using the calculation data or the pixel data and the reference data.

8. A source driver comprising:

a first sensing channel unit configured to sense pixel signals for correcting characteristics of pixels of a display panel;

a second sensing channel unit configured to selectively sense at least one reference voltage for correcting characteristics of the source driver and the pixel signals;

a switching unit configured to selectively transfer the pixel signals and the at least one reference voltage to the second sensing channel unit, wherein the switching unit transfers the at least one reference voltage to the second sensing channel unit so that the second sensing channel unit senses the at least one reference voltage when the first sensing channel unit senses the pixel signals;

a selection unit configured to sequentially output the pixel signals sensed by the first sensing channel unit and the at least one reference voltage sensed by the second sensing channel unit to a analog digital converter according to a prescribed order; and the analog digital converter configured to convert the pixel signals outputted by the selection unit into pixel data and to convert the at least one reference voltage outputted by the selection unit into reference data that is digital values, and to transmit the pixel data and the reference data, wherein the reference data is used to correct the characteristics of the source driver.

9. The source driver of claim 8, wherein the second sensing channel unit senses the at let one reference voltage in synchronization with the first sensing channel unit.

10. The source driver of claim 8, further comprising:

a correction calculation unit configured to calculate the pixel data and the reference data and to provide calculation data obtained by correcting the characteristics of the source driver from the characteristics of the pixels; and a transfer unit configured to transfer the calculation data to a controller or transfer the pixel data and the reference data to the controller.

11. The source driver of claim 10, wherein the controller connects the characteristics of the pixels and offset and gain characteristics of the source driver by using the calculation data or the pixel data and the reference data.

12. A source driver comprising:

a sensing channel unit including sensing channels for sensing pixel signals for correcting characteristics of pixels of a display panel, some of the sensing channels selectively sensing at les one pixel signal and at least one reference voltage for correcting characteristics of the source driver;

a selection unit configured to sequentially output the pixel signals sensed by the sensing channels and the at least one reference voltage sensed by some of the sensing channels to a analog digital converter according to a prescribed order; and the analog digital converter configured to convert the pixel signals outputted by the selection unit into pixel data and the at least one reference voltage outputted by the selection unit into reference data that is digital values, and to transmit the pixel data and the reference data, wherein the reference data is used to correct the characteristics of the source driver, wherein the sensing circuit comprises:

a first sensing channel unit configured to sense the pixel signals;

a second sensing channel unit configured to selectively sense the pixel signals and the at least one reference voltage; and a switching unit configured to selectively transfer the pixel signals and the at least one reference voltage to the second sensing channel unit, wherein the switching unit transfers the at least one reference voltage to the second sensing channel unit, when the first sensing channel unit senses the pixel signals.

13. The source driver of claim 12, wherein the sensing channel unit includes sample and hold circuits corresponding to the pixel signals in a one-to-one manner, and at least one of the sample and hold circuits selectively sample the at let e pixel signal and the at least one reference voltage.

14. The source driver of claim 12, further comprising:

a correction calculation unit configured to calculate the pixel data and the reference data and to provide calculation data obtained by correcting the characteristics of the source driver from the characteristics of the pixels; and a transfer unit configured to transfer the calculation data to a controller or transfer the pixel data and the reference data to the controller.

15. The source driver of claim 1, wherein the sensing circuit senses pixel the at least one reference voltage at a time at which the pixel signals are sensed.

16. The source driver of claim 1, wherein the analog digital converter transmits the pixel data and the reference data to a controller such that the controller is able to perform a operation on the characteristics of the pixels via the pixel data and a operation on the characteristics of the source driver via the reference data.

17. The source driver of claim 8, wherein the second sensing channel unit senses the at least one referee voltage at a time at which the first sensing channel unit senses the pixel signals.

18. The source driver of claim 8, wherein the analog digital converter transmits the pixel data and the reference data to a controller such that the controller is able to perform a operation on the characteristics of the pixels by via the pixel data and an operation on the characteristics of the source driver via the reference data.

19. The source driver of claim 12, wherein the sensing channel unit senses the at least one reference voltage at a time at which the pixel signals are sensed.

20. The source driver of claim 12, wherein the analog digital converter transmits the pixel data and the reference data to a controller such that the controller is able to perform a operation on the characteristics of the pixels via the pixel data and e operation on the characteristics of the source driver via the reference data.

* * * * *